US005855523A

United States Patent [19]

Hatchett

[11] Patent Number: 5,855,523

[45] Date of Patent: Jan. 5, 1999

[54] GOLF SWING TRAINING APPARATUS

[76] Inventor: Phillip Hatchett, 654 Armstrong St., Russellville, Ky. 42276

[21] Appl. No.: 906,295

[22] Filed: Aug. 5, 1997

[51] Int. Cl.[6] ..... A63B 69/36

[52] U.S. Cl. ..... 473/265; 473/225

[58] Field of Search ..... 473/225, 265

[56] References Cited

U.S. PATENT DOCUMENTS

| | | | |
|---|---|---|---|
| 1,409,688 | 3/1922 | Edgar | 473/265 |
| 3,246,898 | 4/1966 | Shoaf | 473/265 |
| 3,561,764 | 2/1971 | Thomas . | |
| 3,784,208 | 1/1974 | Weygandt . | |
| 4,223,891 | 9/1980 | Van Gaasbeek et al. . | |
| 4,826,174 | 5/1989 | Hoyt, Jr. . | |
| 5,000,457 | 3/1991 | Brown . | |
| 5,263,719 | 11/1993 | Bunn . | |
| 5,346,220 | 9/1994 | Cooper et al. . | |
| 5,348,304 | 9/1994 | Meade . | |
| 5,350,177 | 9/1994 | Furbush, Jr. . | |
| 5,417,428 | 5/1995 | Warren . | |
| 5,520,391 | 5/1996 | Howe . | |

*Primary Examiner*—George J. Marlo
*Attorney, Agent, or Firm*—Trask, Britt & Rossa

[57] ABSTRACT

A lightweight and portable golf training apparatus for improving and perfecting a proper golf club swing is disclosed. The apparatus includes a first guide member that is elevated from the ground and a substantially linear side barrier section, which lies substantially parallel to the intended flight path of the golf ball. A curved edge provides a visual and physical guide to mark the path arc of a properly executed swing. A second guide member is disposed adjacent to the curved edge of the first guide member. The second guide member includes a top surface that is elevated from the ground. Forming a side of the second guide member is a substantially linear main guiding section, which, when positioned in a substantially parallel alignment with the curved edge of the first guide member, defmes a curved pathway for guiding a golf club through the proper swing arc. The apparatus may also include fastening means to secure the apparatus to the ground and an alarm to alert the golfer when contact is made with any part of the apparatus. A method of using the golf swinging apparatus is also disclosed.

20 Claims, 3 Drawing Sheets

GOLF SWING TRAINING APPARATUS

BACKGROUND OF THE INVENTION

1. Field of the Invention

The present invention relates generally to golf practicing aids and more particularly to a method and apparatus that allows a golfer to practice and develop a perfect swing without any damage to the golfer or to the golf club.

2. State of the Art

One of the most important and basic skills required to properly play the game of golf is developing a consistent and accurate swing. Even highly experienced and professional golfers must occasionally analyze and practice their swing patterns and correct bad habits. The golf swing is particularly difficult to learn and master because it is highly complex and involves a number of variables that must be executed with precision in order to hit the ball accurately and at a desired distance. Such variables include movement during the backswing and foreswing, foot placement relative to the ball, body orientation and position, tempo or pace of the swing, weight balance and shift during the backswing and foreswing, and club head speed and follow through.

One of the most frequent problems encountered by golfers is a golf shot created by an outside-to-inside club head path, otherwise known as "over the top." This motion of the club head readily produces the widely-known golf shot commonly referred to as a "slice," that is, a ball that veers or curves excessively toward the outside of the golfer's swing. A slice occurs when the head portion of the club is in its lowermost position immediately adjacent the ground with the club face open. As a result of this type of incorrect swing, the club head does not meet the ball squarely due to an incorrect swing motion that causes the golfer to swing the club too close to his or her body. This prevents the golfer from properly releasing the club at impact with the golf ball and causes the ball to slice.

In order to correct the aforementioned and other problems associated with incorrect swings, golfers are instructed to modify their existing swing, orientation, weight transfer, and grip, to name a few, and to practice swinging accordingly. While these verbal instructions are at least partially effective in most instances, the result of such instructions are less than perfect. This outcome is at least partially due to the fact that constant feedback is missing, such as when a golfer practices alone without an instructor present, or that practice sessions and lessons are impractical or taken infrequently.

In response to this problem, various devices have been developed for the purpose of improving a golfer's swing. A multitude of golf training devices is known in the art, which can generally be divided into two broad classifications: planar mat apparatus upon which the ball is placed, and raised devices that provide a barrier means to control the swing of the club. Some of the planar mat apparatus provide for ball placement upon a mat. The placement of the ball on the surface of the mat can preclude a truly authentic practice stroke since, other than when driving off of a tee, the club head will regularly contact the surface. Moreover, the planar mat apparatus are not intended to be used and usually do not work well on a grass surface. While other planar mat apparatus do allow contact of the ball with the grass, these apparatus only provide visual guidance to train the golfer and do not provide a physical barrier to prevent a golfer from swinging incorrectly. Examples of planar mat apparatus possessing the aforementioned limitations include U.S. Pat. No. 4,826,174 to Hoyt, Jr., U.S. Pat. No. 5,348,304 to Meade, U.S. Pat. No. 3,784,208 to Weygandt, U.S. Pat. No. 5,417,428 to Warren, and U.S Pat. No. 3,561,764 to Thomas.

The second category of devices, those having a means to control the swing of the club, generally include a structural member that prevents or interferes, at least partially, with the path of a club at an incorrect or non-intended angle or direction. However, these devices are either limited to preventing the path of the club in a single direction or angle, to restricting the path of the club head in a generally linear fashion, or to restricting the height of the club head during the swing. Examples of raised devices possessing the aforementioned limitations include U.S. Pat. No. 5,346,220 to Cooper et al., U.S. Pat. No. 5,350,177 to Furbush, Jr., and U.S. Pat. No. 5,263,719 to Bunn.

In view of the foregoing limitations, there is a need in the golf training industry for an apparatus and method of training that provides both a visual as well as a physical guide to prevent the execution of an incorrect golf swing. Furthermore, there is a need in the industry for such an apparatus that is relatively inexpensive to manufacture and sufficiently lightweight for easy transport.

SUMMARY OF THE INVENTION

The present invention is directed to a lightweight and portable golf training apparatus for improving a golf club swing. The golf training apparatus includes a first guide member that is elevated from the ground at least to a height greater than the height of a golf ball. The first guide member includes a substantially linear side barrier section, which lies substantially parallel to the intended flight path of the golf ball, that is used as a guide to aid the golfer in positioning of his or her feet at a proper distance from the ball. A curved edge provides a visual and physical guide to mark the path arc of a properly executed swing. A second guide member is disposed adjacent to the curved edge of the first guide member. The second guide member includes a top surface that is elevated from the ground at least to a height greater than that of a golf ball. Forming a side of the second guide member is a substantially linear main guiding section, which, when positioned in a substantially parallel alignment with the curved edge of the first guide member, defines a curved pathway for guiding a golf club through the proper swing arc.

Another representative embodiment of the golf training apparatus additionally includes a first guide member having a substantially horizontal top surface as an uppermost surface, a curved edge, and an angled surface disposed between the top surface and the curved edge. The angled surface is disposed downwardly and away from the top surface at an angle of approximately 45 degrees to permit passage of the club head and shaft during execution of the swing. Also included is a linear edge that projects forwardly from the curved edge along a substantially straight line to prevent a golfer from approaching the ball in an incorrect linear fashion and then, in an effort to correct the improper approach, curving the club head swing just prior to contact with the ball. A ball alignment marker can also be included on the top surface and on the angled surface to indicate the proper placement of the ball within the pathway created by the first and second guide members.

The second guide member additionally includes a second guiding section that projects forwardly from the main guiding section along a substantially straight line that extends away from said curved pathway at an angle. An alarm is also included and disposed on the top surface of the second guide member to alert the golfer when the second guide member has been contacted. In similar fashion, the alarm can also be placed on a top surface of the first guide member to alert the golfer of any contact with the first guide member.

In another alternative embodiment, fastening means are attached to the first and second guide members to secure the guide members to the ground or floor on which they are placed.

A method of using a golf training apparatus is also disclosed wherein the first guide member is placed upon a surface and aligned to the left of the intended target or line of trajectory with a plane formed by the side barrier section. The second guide member is then placed upon the surface and the linear main guiding section of the second guide member is aligned to lie substantially parallel to a center of the curved edge of the first guide member in order to create a sufficiently wide pathway to permit passage of a golf club head therethrough. A golf ball is then placed within the pathway at a point delineated by the marker on the first guide member. The golfer then positions his or her feet behind the side barrier section of the first guide member and begins swinging the golf club along the pathway to cause the golf ball to travel along a desired trajectory.

BRIEF DESCRIPTION OF THE DRAWINGS

While the specification concludes with claims particularly pointing out and distinctly claiming that which is regarded as the present invention, the advantages of this invention can be more readily ascertained from the following description of the invention when read in conjunction with the accompanying drawings in which:

DETAILED DESCRIPTION OF THE PREFERRED EMBODIMENTS

Figure 1:
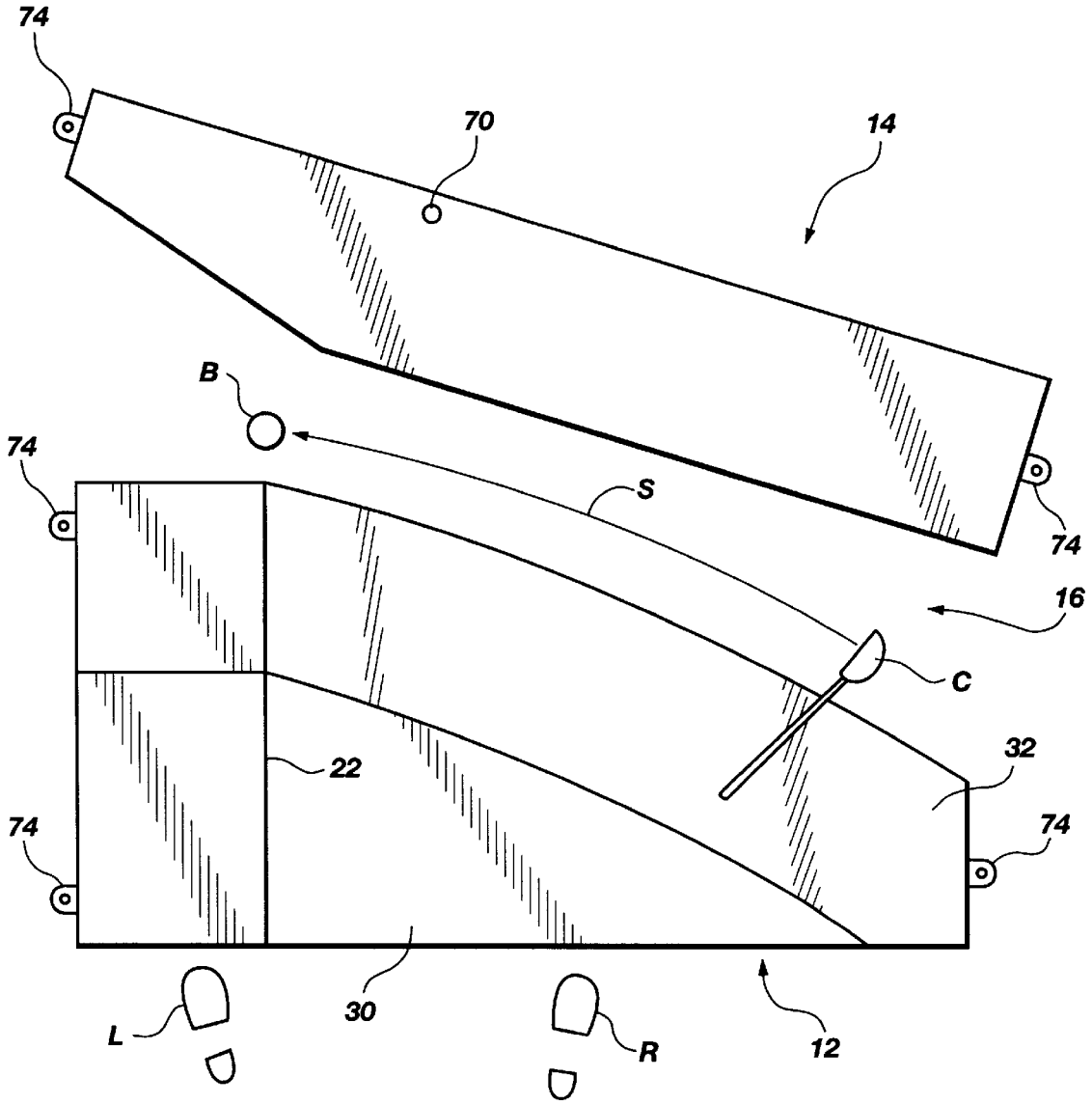
FIG. 1 is a top plan view of the golf training apparatus of the present invention, illustrating the positioning of the inner and outer guide members comprising the apparatus.

Referring to FIG. 1, a golf training apparatus for practicing and instructing the use of a proper golf swing is illustrated. Although the golf training apparatus, as shown, is constructed for use by a right-handed golfer, the apparatus can be designed and manufactured as a mirror image of the presently-illustrated embodiment for use by a left-handed golfer. Therefore, references to "left" and "right" used throughout this description can be interposed and should not be viewed as limitations with respect to location.

The golf training apparatus generally comprises an inner guide member 12 and an outer guide member 14, each of which is adapted to be placed on any substantially flat surface, such as the ground of a practice or playing area. Outer guide member 12 and inner guide member 14 are positioned in such a manner as to form a pathway or channel 16 that permits passage of a golf club head (designated as "C") therethrough upon execution of a proper swing. It should be noted that the terms "inner" and "outer" used herein refer to the position of guide members 12 and 14 being nearest and farthest, respectively, from the golfer when the golf training apparatus is in use. To facilitate proper placement of guide members 12 and 14 with respect to one another, as described herein, a pattern can also be included to delineate a preferred or desired layout of guide members 12 and 14.

Guide members 12 and 14 can be made of any suitable material that is substantially resilient and which preferably lends itself to well known manufacturing techniques, such as molding. A preferred material for use is foam rubber. Guide members 12 and 14 can be made of any color, but are preferably colored so as to create the greatest visual contrast against the intended background, which is typically green grass.

Markers can be included on inner guide member 12 in order to provide placement information for the golfer with respect to his or her stance, swing alignment and ball placement. In the presently-illustrated preferred embodiment, marker 22 is used to indicate the proper placement of a golf ball (designated as "B") within pathway 16 and may additionally be used to indicate the proper placement of the left foot (designated as "L") when addressing golf ball B. Although only marker 22 is detailed in the present embodiment, it is understood that other markers can be included to mark various other alignments and positions, such as the alignment of the golfer's right foot (designated as "R").

Figure 2:
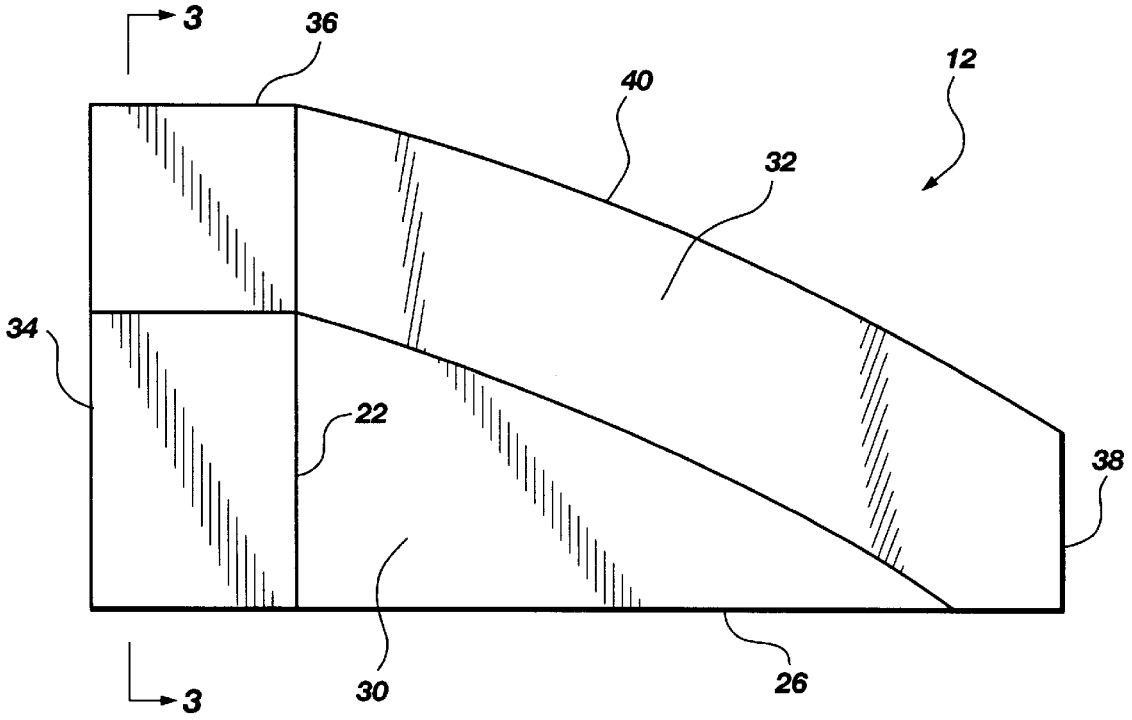
FIG. 2 is a top plan view of the inner guide member of the golf training apparatus specifically illustrating the position of the top surface and angled surface of the inner guide member.
Figure 3:
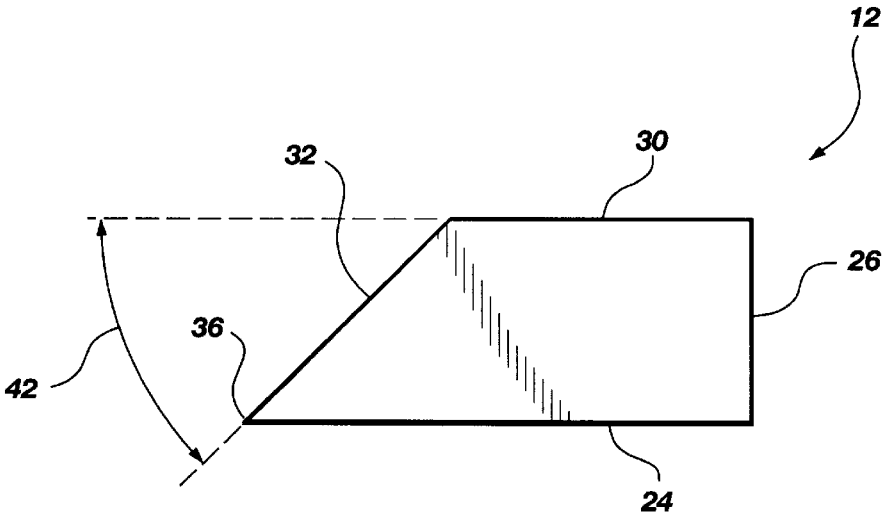
FIG. 3 is a transverse sectional view of the inner guide member taken along line 3—3 of FIG. 2.

More specifically, and with additional reference to FIGS. 2 and 3, inner guide member 12 includes a front side 34, a back side 38, a side barrier section 26, and an angled surface 32. Side barrier section 26 extends horizontally along the length of the inner guide member 12, from back side 38 to front side 34. Side barrier section 26 can be made in different heights in order to accommodate personal preferences for individual golfers. While a taller section 26 provides high visual impact and less room for error, thus enhancing and speeding up the learning process, the resulting creation of a larger obstacle to swing through can be seen as a detriment by some. While no limitations on height exist, it has been found that side barrier sections having a height of about 4 to about 11 inches provide the best results for most golfers.

Inner guide member 12 includes a substantially flat base portion 24 that is adapted to be placed and rest stably on any substantially flat surface. Inner guide member 12 further includes a top surface 30 that is in substantially parallel orientation in relation to base portion 24. Angled surface 32 lies adjacent to top surface 30 and terminates at a curved edge 40 and a linear edge 36. Angled surface 32 is oriented at an angle 42 that provides sufficient room for the shaft of the club to pass through pathway 16 while executing a golf swing. Accordingly, inner guide member 12 can be customized for golfers of different heights by adjusting the angle 42 of the angled surface 32. Preferably, angled surface 32 has an angle of about 45 degrees, which advantageously accommodates golfers having a wide range of heights and permits placement of edges 36 and 40 in close proximity to the ball B so as to visually narrow the pathway 16.

Back side 38 extends from side barrier section 26 to curved edge 40 and can vary in size, typically having a width of about 6 inches. Alternatively, back side 38 can be eliminated altogether by extending curved edge 40 past the point where it currently intersects with back side 38 until curved edge 40 tapers into side barrier section 26.

Curved edge 40 comprises an outwardly projecting curb that is configured to have a length and curvature corresponding to a desirable golf swing. While the configuration of curved edge 40 can be modified and customized to varying degrees, a preferred embodiment of inner guide member 12 has a curved edge 40 configuration that corresponds to the arc and path of a "perfect"golf swing, as determined by delineating the arc and path of a swing executed by a golf swing device, such as the Iron Byron (manufactured by True Temper, Memphis, Tenn.). In a most preferred embodiment, curved edge 40 has a length of 28.5 inches and 93.30 radians.

Linear edge 36 comprises a substantially straight line that lies adjacent curved edge 40. Linear edge 36 provides a barrier that prevents the golfer from swinging the golf club in a straight line into the ball B and then pulling the golf club across at an angle just prior to contact with the ball B. When such an incorrect swing is attempted, the club head C hits a portion of the linear edge 36 and provides the golfer with instant feedback. Although varying lengths are envisioned, a preferred embodiment of the invention has a linear edge 36 of about 7 inches in length.

Figure 4:
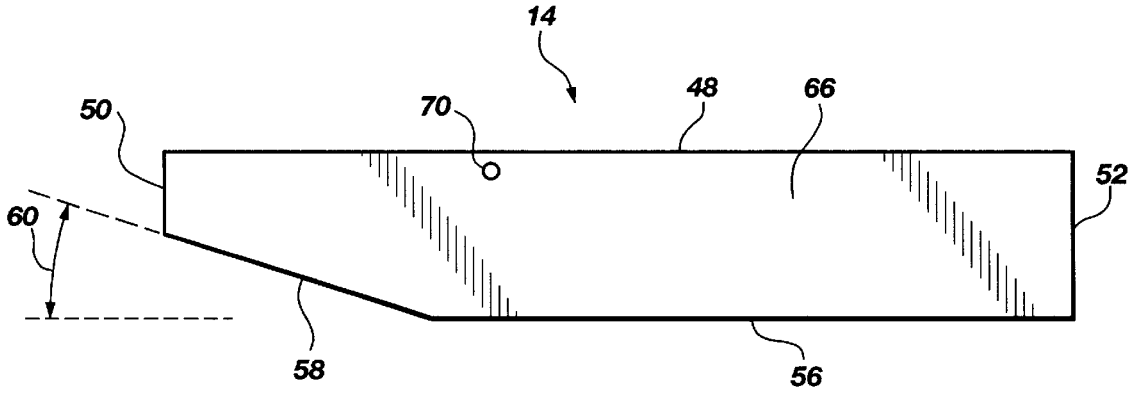
FIG. 4 is a top plan view of the outer guide member of the golf training apparatus.
Figure 5:
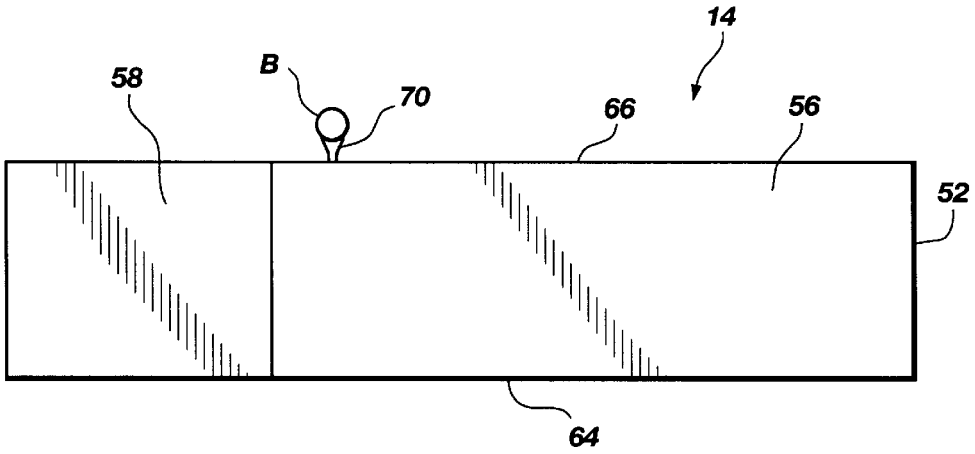
FIG. 5 is a side view of the outer guide member of FIG. 4.

Referring to FIGS. 4 and 5, outer guide member 14 includes a left side 50, a right side 52, and a rear side 48 that extends along the length of the outer guide member 14 and continuously from left side 50 to right side 52. Outer barrier 56 extends along the front side of outer guide member 14, extending from right side 52 and terminating at a cutout section 58. Outer barrier 56 should have a sufficiently tall height to restrict passage of the club head over outer guide member 14 when an imperfect swing is executed. Preferably, outer barrier 56 has a height in the range of about 4 to about 12 inches, most preferably having a height of about 8 inches.

Cutout section 58 extends continuously from outer barrier 56 to left side 50 and is oriented at an angle 60 that provides an extended opening to permit ball B adequate space to start on the proper path after being hit with the club C. Orientation of cutout section 58 at an angle 60 also eliminates or reduces the possibility of hitting cutout section 58 with the club during execution of a perfect swing. Although cutout section 58 can be designed to have various lengths and be angled at various degrees, a preferred embodiment of the invention includes a cutout section 58 that is about 10 inches in length and that is angled at about 16.7 degrees toward rear side 48 relative to the plane formed by outer barrier 56.

As shown in FIG. 5, outer guide member 14 includes a substantially flat base portion 64 that is adapted to be placed and rest stably on any substantially flat surface, and a top surface 66 that lies in substantially parallel alignment with base portion 64. Top surface 66 may also include an alarm member 70. Since most users of the golf training apparatus will improve their swing rapidly, incorporation of alarm 70 alerts the golfer when outer guide member 14 has been contacted, no matter how lightly, particularly when top surface 66 has been contacted. Any impact from the club on the down swing will trigger the alarm 70. Alarm 70 can comprise any method or device that audibly or visually alerts the golfer when contact with the outer guide member 14 has occurred.

As further illustrated in FIG. 5, an inexpensive and simple version of alarm 70 can consist of a ball B resting on a golf tee. Any contact with outer guide member 14 causes ball B to fall off the tee, informing the user that the swing was slightly outside-to-in or over the top. As illustrated in FIG. 4, alarm 70 is preferably positioned proximate to rear side 48 and toward the left side of the outer guide member 14 so as to prevent or reduce the chances of directly striking alarm 70 with club head C. Alternatively or additionally, alarm 70 can be included on top surface 30 of inner guide member 12 to alert the golfer when inner guide member 12 has been contacted.

The golf training apparatus can also include securing means to secure inner guide member 12 and outer guide member 14 to the ground or surface. Any suitable securing means known in the art, such as spikes or VELCRO strips, may be used. As illustrated in FIG. 1, the securing means preferably is a loop or eyelet 74 that is attached to various portions of inner guide member 12 and outer guide member 14. Once the golf training apparatus has been properly positioned, ground spikes can be inserted through eyelet 74. Eyelet 74 can be attached directly to various sections or portions of guide members 12 and 14. Alternatively, eyelet 74 can be attached to a sheet of insulative material, preferably vinyl, that is attached to and coextensive with base portion 24 of inner guide member 12 and base portion 64 of outer guide member 14, which provides insulation and protection to base portions 24 and 64 during use of the golf training apparatus. In yet another embodiment, the sheet of insulative material can be formed to overlap all of the exposed areas of inner guide member 12 and outer guide member 14 (i.e., all areas other than base portions 24 and 64) with eyelets 74 extending therefrom for fastening into the ground.

The golf training apparatus is typically used at a golf course, driving range or similar area. The golf training apparatus may be removed from a storage compartment or carrying bag and be positioned on the playing or practice surface with inner guide member 12 and outer guide member 14 spaced apart as desired to form pathway 16. Specifically, inner guide member 12 should be positioned on the ground by aiming the plane of side barrier section 26 at the intended target. Outer guide member 14 is then placed on the ground at the proper angle in relation to inner guide member 12, as shown in FIG. 1 and as detailed in the enclosed pattern (discussed above), making sure to leave 2 inches of clearance on either side of the club being used. Ball B is then teed up or placed on the ground at the position marked by marker 22 so that the golfer can begin practicing his or her golf swing.

With reference to FIG. 1, the foreswing motion of a club head C during a swing is illustrated with respect to the positioning of the golf training apparatus. Club head C forms a generally circular arc (designated as "S") both during the back swing and forward swing of the club that normally lies in a plane which is at some angle between a vertical and horizontal plane. When this swing is executed with the aid of the golf training apparatus, swing arc S is restricted to a specific angle and radius, thus forcing the golfer to execute a perfect swing. As previously described, such an angle and radius are principally defined by curved edge 40 and outer barrier 56 which, in turn, define pathway 16.

Any lateral error in the circular arc S of club head C will result in club head C striking either the inner guide member 12 or the outer guide member 14, thus causing the club head C to glance off the device prior to hitting ball B or causing activation of alarm member 70. Thus, any error in executing a perfect swing stroke will become immediately apparent to the golfer using the golf training apparatus. Accordingly, adjustments may be made in the swing stroke until consistency is developed. As the golfer improves his or her swing, inner guide member 12 and outer guide member 14 can be repositioned to lie closer together so as to narrow pathway 16 in order to require even greater accuracy by the user. Thus, an extremely accurate and consistent swing stroke may be developed through the use of the swing training apparatus.

Although the preferred embodiments of the present invention have been disclosed for illustrative purposes, those skilled in the art will appreciate that various modifications, additions, and substitutions are possible, without departing from the scope and spirit of the invention as disclosed in the accompanying claims.

What is claimed is:

1. A golf training apparatus, comprising.

a first guide member having a height greater than the height of a golf ball, a substantially horizontal top surface, a curved edge, and an angled surface disposed between said top surface and said curved edge, said angled surface extending downwardly and away from said top surface; and a second guide member disposed adjacent said curved edge of said first guide member, said second guide member having a top surface and a height greater than the height of a golf ball and having a substantially linear main guiding section, said curved edge and said main guiding section defming a curved pathway for guiding a golf club.

2. The apparatus of claim 1, wherein said angled surface is disposed at an angle of approximately 45 degrees in relation to said top surface.

3. The apparatus of claim 1, wherein said first guide member further comprises a linear edge that projects forwardly from said curved edge along a substantially straight line.

4. The apparatus of claim 3, wherein said linear edge has a length of approximately 7 inches.

5. The apparatus of claim 1, wherein said curved edge has a length of approximately 28.5 inches and approximately 93.30 radians.

6. The apparatus of claim 1, wherein said second guide member further comprises a second guiding section that projects forwardly from said main guiding section along a substantially straight line that extends angularly away from said curved pathway.

7. The apparatus of claim 6, wherein second guiding section is disposed at an angle of approximately 17 degrees in relation to said main guiding section.

8. The apparatus of claim 1, wherein said first guide member further comprises a marker to indicate a proper alignment of the golf ball within said pathway.

9. The apparatus of claim 1, wherein said second guide member further comprises an alarm disposed on said top surface of said second guide member.

10. The apparatus of claim 9, wherein said alarm comprises a golf ball disposed on top of a golf tee.

11. The apparatus of claim 1, wherein said first guide member and said second guide member further comprise fastening means attached thereto.

12. The apparatus of claim 11, wherein said fastening means is formed from vinyl and is formed in the shape of an eyelet.

13. The apparatus of claim 1, wherein said first guide member and said second guide member have a height of approximately 7 to 11 inches.

14. The apparatus of claim 1, further comprising a pattern outlining shapes of said first guide member and said second guide member to assist in the proper positioning thereof with respect to one another.

15. The apparatus of claim 1, wherein said first guide member and said second guide member have a length of approximately 33 inches.

16. The apparatus of claim 1, wherein said first guide member and said second guide member are formed from a resilient material.

17. The apparatus of claim 16, wherein said resilient material is foam rubber.

18. A golf training apparatus, comprising. a first guide member having a substantially horizontal top surface, a curved edge, a linear edge that projects forwardly from said curved edge along a substantially straight line, a ball alignment marker, and an angled surface disposed between said top surface and said curved edge, said angled surface being disposed downwardly and away from said top surface at an angle of approximately 45 degrees; and a second guide member disposed adjacent said curved edge of said first guide member, said second guide member having a top surface, a height of approximately 8 inches, a substantially linear main guiding section, said curved edge and said main guiding section defining a curved pathway for guiding a golf club, a second guiding section that projects forwardly from said main guiding section along a substantially straight line that extends away from said curved pathway at an angle of about 17 degrees, and an alarm disposed on said top surface.

19. The apparatus of claim 18, wherein said curved edge has a length of approximately 28.5 inches and approximately 93.30 radians.

20. The apparatus of claim 18, wherein said first guide member and said second guide member further comprise fastening means attached thereto.

* * * * *